US006622331B2

(12) United States Patent
Yanagi

(10) Patent No.: US 6,622,331 B2
(45) Date of Patent: Sep. 23, 2003

(54) BOOT SHAPE RETAINER AND A SUSPENDING DEVICE THEREFOR

(75) Inventor: Shojiro Yanagi, Kishiwada (JP)

(73) Assignee: Fl Co., Ltd., Osaka (JP)

( * ) Notice: Subject to any disclaimer, the term of this patent is extended or adjusted under 35 U.S.C. 154(b) by 14 days.

(21) Appl. No.: 09/873,266

(22) Filed: Jun. 5, 2001

(65) Prior Publication Data

US 2002/0000014 A1 Jan. 3, 2002

(30) Foreign Application Priority Data

| | | |
|---|---|---|
| Aug. 9, 2000 | (JP) | 2000-241024 |
| Jul. 3, 2000 | (JP) | 2000-200614 |
| Mar. 16, 2001 | (JP) | 2001-077299 |
| Feb. 19, 2001 | (JP) | 2001-000742 |

(51) Int. Cl.[7] ..... A43D 5/00; A43D 3/00; A43D 3/14

(52) U.S. Cl. ..... 12/114.2; 12/114.8; 12/116.2; 12/128 C

(58) Field of Search ..... 12/114.2, 114.4, 12/114.6, 114.8, 115.2, 115.4, 116.2, 116.4, 116.6, 116.8, 117.2, 117.4, 119.5, 123.5, 128 C; 211/34, 37, 38

(56) References Cited

U.S. PATENT DOCUMENTS

| | | | | | |
|---|---|---|---|---|---|
| 1,406,276 | A | * | 2/1922 | Novitzky | 12/115.2 |
| 1,989,597 | A | * | 1/1935 | Johnston | 12/114.6 |
| 2,025,173 | A | | 12/1935 | Meyer | |
| 2,105,395 | A | * | 1/1938 | Baas | 12/114.6 |
| 2,270,936 | A | * | 1/1942 | Doering et al. | 12/114.6 |
| 3,229,314 | A | * | 1/1966 | Hyams | 12/114.6 |
| 3,276,053 | A | * | 10/1966 | McKesson | 12/114.6 |
| 3,965,515 | A | * | 6/1976 | Moberly | 12/114.6 |
| 4,185,347 | A | * | 1/1980 | Yang | 12/114.6 |
| 4,254,524 | A | * | 3/1981 | Okui | 12/114.6 |
| 4,953,715 | A | * | 9/1990 | Celli | 211/34 |
| 5,224,607 | A | | 7/1993 | Koresko | |
| 5,294,007 | A | * | 3/1994 | Edmondson | 211/34 |
| 5,423,435 | A | * | 6/1995 | Pollard et al. | 211/37 |
| 5,446,936 | A | * | 9/1995 | Barger | 12/128 C |
| 6,119,871 | A | * | 9/2000 | Mengel | 211/34 |
| 6,266,837 | B1 | * | 7/2001 | Nord | 12/114.2 |

FOREIGN PATENT DOCUMENTS

| | | | | |
|---|---|---|---|---|
| DE | 72 15 879 | | 7/1972 | |
| DE | 38 37 820 A1 | | 5/1990 | |
| DE | 3837820 | * | 5/1990 | 12/114.6 |
| DE | 41 16 599 A1 | | 11/1992 | |
| WO | WO 9706717 | | 2/1997 | |

OTHER PUBLICATIONS

Japanese Patent Laid–Open No. 9–10089 (Jan. 14, 1997) * English translation.

Japanese Patent Laid–Open No. 10–113497 (May 6, 1998) * English translation.

* cited by examiner

*Primary Examiner*—Anthony D. Stashick

(74) *Attorney, Agent, or Firm*—Armstrong, Westerman & Hattori, LLP

(57) ABSTRACT

A boot retainer can store boots without losing the shape. The retainer includes inner pads capable of moving to conform to the interior surface at two or more points of the boot of different sizes, and also includes a hook for suspending the retainer together with the boot.

3 Claims, 17 Drawing Sheets

Fig.10
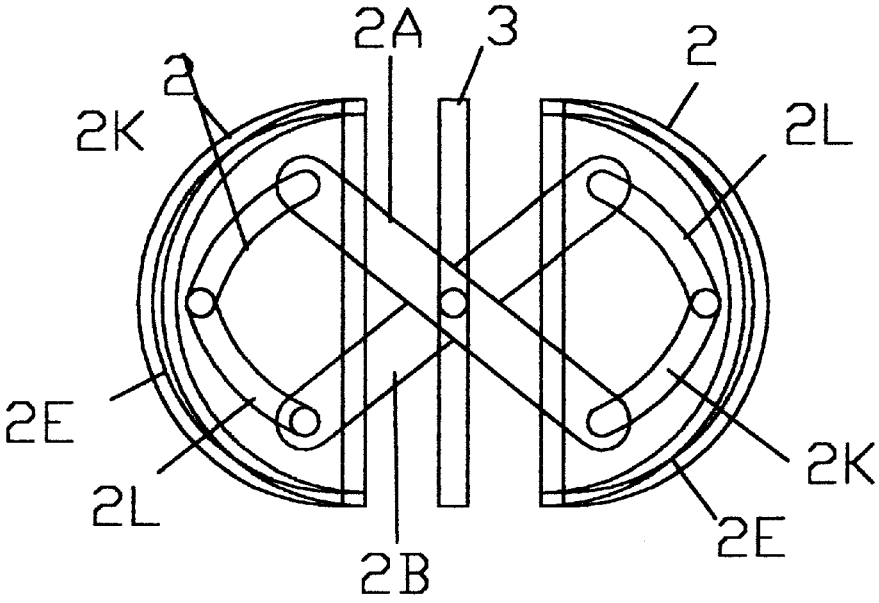
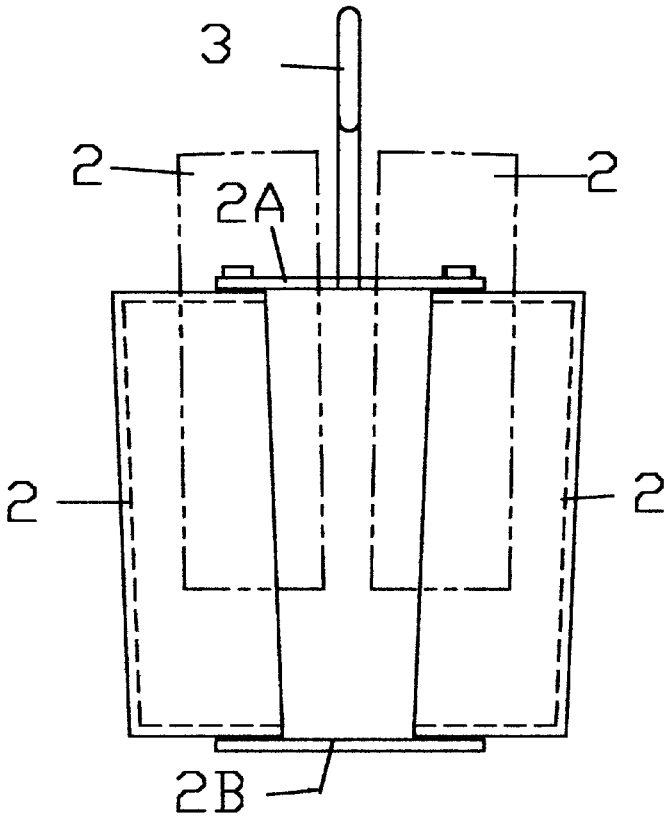
Fig.11

BOOT SHAPE RETAINER AND A SUSPENDING DEVICE THEREFOR

TECHNICAL FIELD

The present invention relates to a boot shape-retainer and a suspending device for keeping the shape of a boot.

BACKGROUND ART

Boots, particularly high boots are soft and flexible to be readily collapsed when placed in shoe shelves or stored in other places. In order to prevent the collapsing, it has been proposed to insert a filling into the boot or to grip the upper end of the boot and hang it upside down. However, the insertion of the filling becomes troublesome for the high boots and sees no practical merit. Although the upside-down hanging of the boot with the use of a grip is suitable for easy boot storing, it causes a certain deformation of the boot and leave creases on the gripped end of the boot.

DISCLOSURE OF THE INVENTION

In view of the above problems, the present invention has been contemplated to provide a boot shape retainer and an associated device which is capable of assuring easy daily boot maintenance while hanging the boot without causing any undesired boot deformation. The boot shape retainer in accordance with the present invention is designed to have inner pads 2 movable to conform to a boot 1 at two or more points around the interior circumference of the boot, and a hook 3 connected to the inner pads and adapted to be engaged with a suspending device for suspending the boot shape retainer. Thus, the boot can be easily suspended simply by placing the inner pads into the boot and can be kept suspended without losing its shape. Therefore, it is easy to make a daily boot maintenance without losing the shape of the boot.

Further, when the inner pads 2 are spring-loaded, it is possible to restore the shape of the boot soaked in the rain or smooth wrinkles of the boot.

When the inner pads 2 are pivotally supported to the opposite ends of a link 2A, the boot receives less contacting pressure and is therefore capable of retaining soft boot or wet boot without losing its shape.

When using pneumatic pressure for holding the boot, it is easy to avoid deformation of the boot and to restore the original shape by regulating the pressure.

Further, the hook 3 allows the boot shape retainer to be suspended to a stand as retaining the shape of the boot 1, and is also utilized to be engaged with a rail or the hanger in the shoe cupboard for storing the boot therein or engaged with a suitable member to be displayed in a shoe counter.

When the stretcher rod 4 is utilized, the retainer inserted in the boot can make the boot self-standing without requiring the stand, enabling the boot to be stored in shelves or suitable space as being kept standing. Further, since the boot can be handled by the sole, it is easy to engage the boot with a supporting structure at a high location, facilitating the boot storage at the high place in the house or the boot display at the high place in the shoe counter.

Further, when combined with the movable stand 7, the retainer can hold the boot 1 in a desired space.

When the furniture 51 such as the shoe locker is provided with a hanger 52 for suspending the retainer therein, the boot 1 can be neatly stored in the furniture without losing its shape by the inner pads inserted therein.

The furniture 51 is only required to add the hanger 52, the boot shape retainer can be easily adapted to the existing furniture without largely modifying the structure of that furniture and without detracting from the appearance of furniture.

Vertical adjustment for the position of suspending the boot can be made by adjusting the corresponding position of the brackets or braces supporting the partition 56 for the shoe cupboard, and the mounting position of the same to the side plates 57 of the locker.

When the boot shape retainer is incorporated in the locker, it is preferred to provide a pair of hangers on a lower surface of the partition at lateral opposite ends near the side plates. Thus, a long coat frequently taken together with the boot can be nicely stored in the locker while leaving the hem of the coat free from the boot 1. When the two boot shape retainers (A) are held suspended from the one hanger 52, the front end of the hanger 52 is preferred to be spaced from the interior wall of the furniture 51 for storing the long coat with its hem kept free from the boot.

When the hanger 52 are foldably or removable mounted to the side plate 57, the furniture can make the use of a wide interior space when not utilized for storage of the boots.

BRIEF DESCRIPTION OF THE DRAWINGS

FIG. 10 is a top view of the above;

FIG. 11 is schematic view showing the use of the above;

MODE FOR CARRYING OUT THE INVENTION

Figure 1:
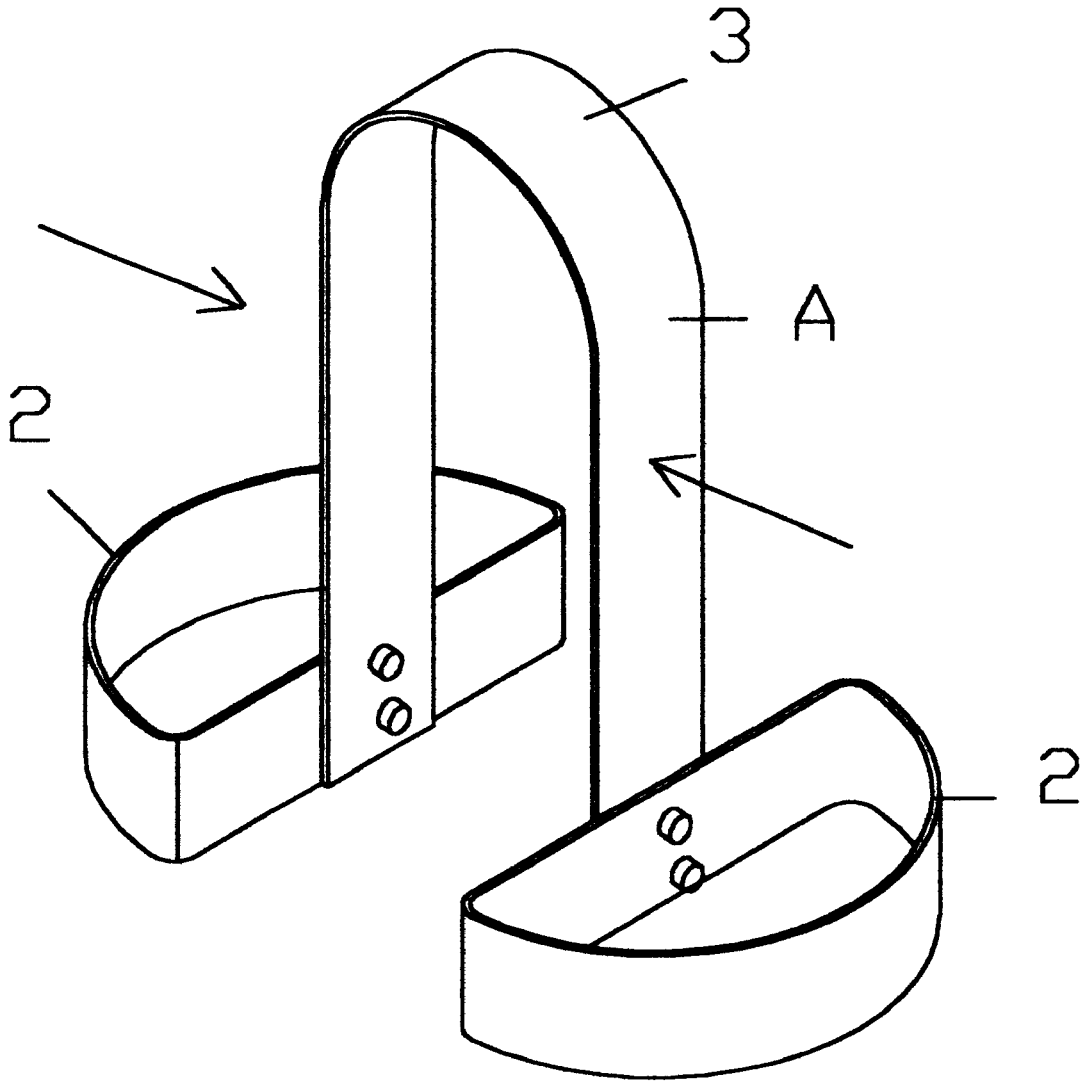
FIG. 1 is a perspective view of a first embodiment of the present invention.

FIG. 1 shows a boot shape retainer (A) in accordance with a first embodiment of the present invention which includes a U-shaped spring carrying inner pads 2 at opposite ends of the spring. The spring may be made of a metal, plastic, bamboo or the like material. More than two inner pads 2 may be provided as necessary. The inner pad 2 is made of an elastic resin or resin coated metal sheet so as to be harmless to an interior of a boot 1.

Figure 2:
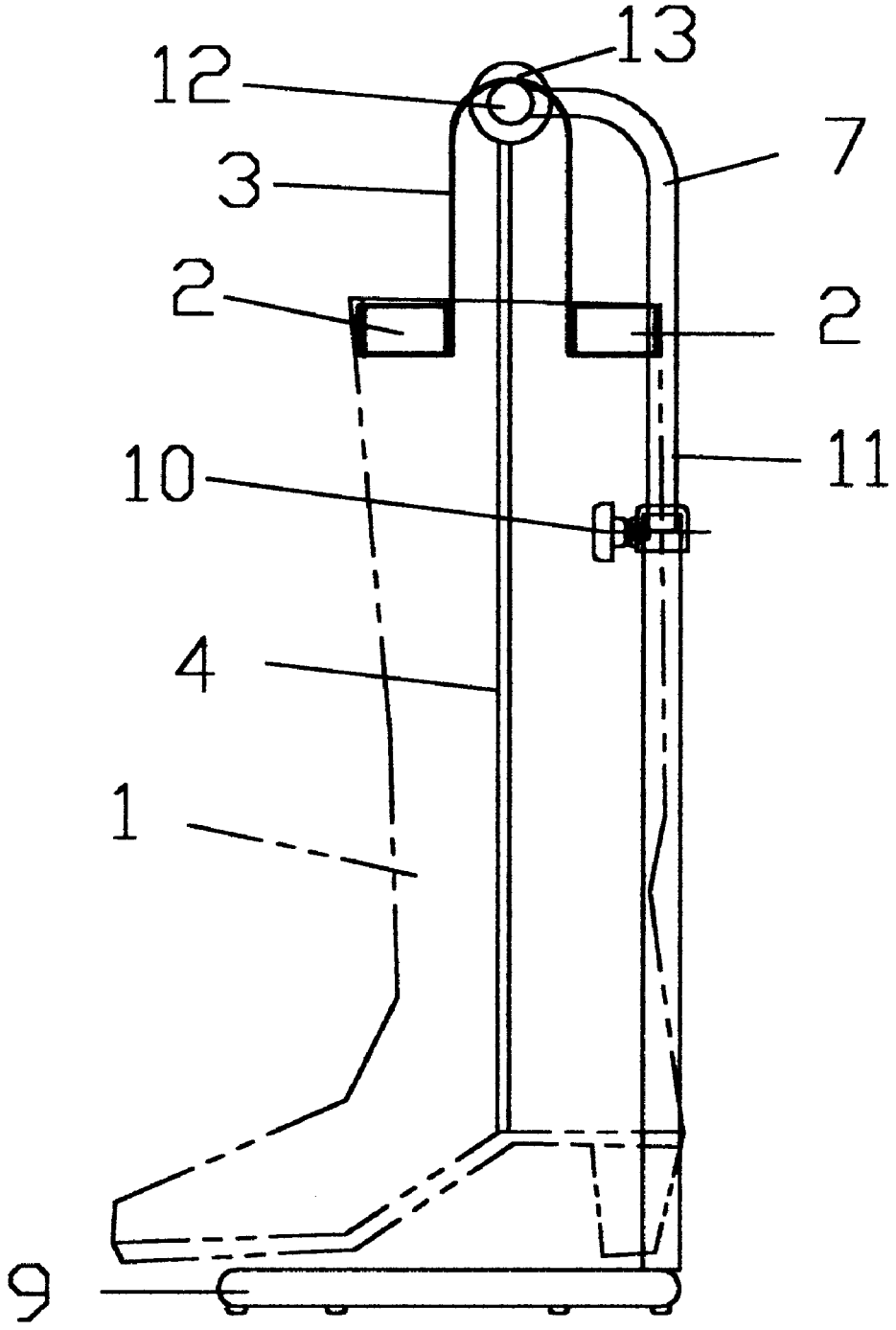
FIG. 2 is a schematic view showing the use of the above.

FIG. 1 shows a condition in which forces are applied from arrowed directions to the spring. Upon releasing the forces, the spring expands to press the inner pads against the interior of the boot 1, thereby holding the boot by the spring force. The inner pads are arranged to have the opposite outer faces spaced slightly greater than the inside diameter of the boot 1, when the spring receives no external force. Thus, after placing the inner pads 2 inside of the boot 1 by deforming the spring inward and subsequently releasing the spring, the inner pads are caused to be pressed against the interior of the boot 1, as shown in FIG. 2. In this condition, the boot 1 may be left stood on the floor or may be stored in a shoe cupboard as being suspended from a hanger or rail inside of the shoe cupboard by engaging a hook 3 at the upper end of the spring, i.e., the retainer (A). Further, the boot 1 may be suspended from a stand 7 as will be explained later.

Figure 3:
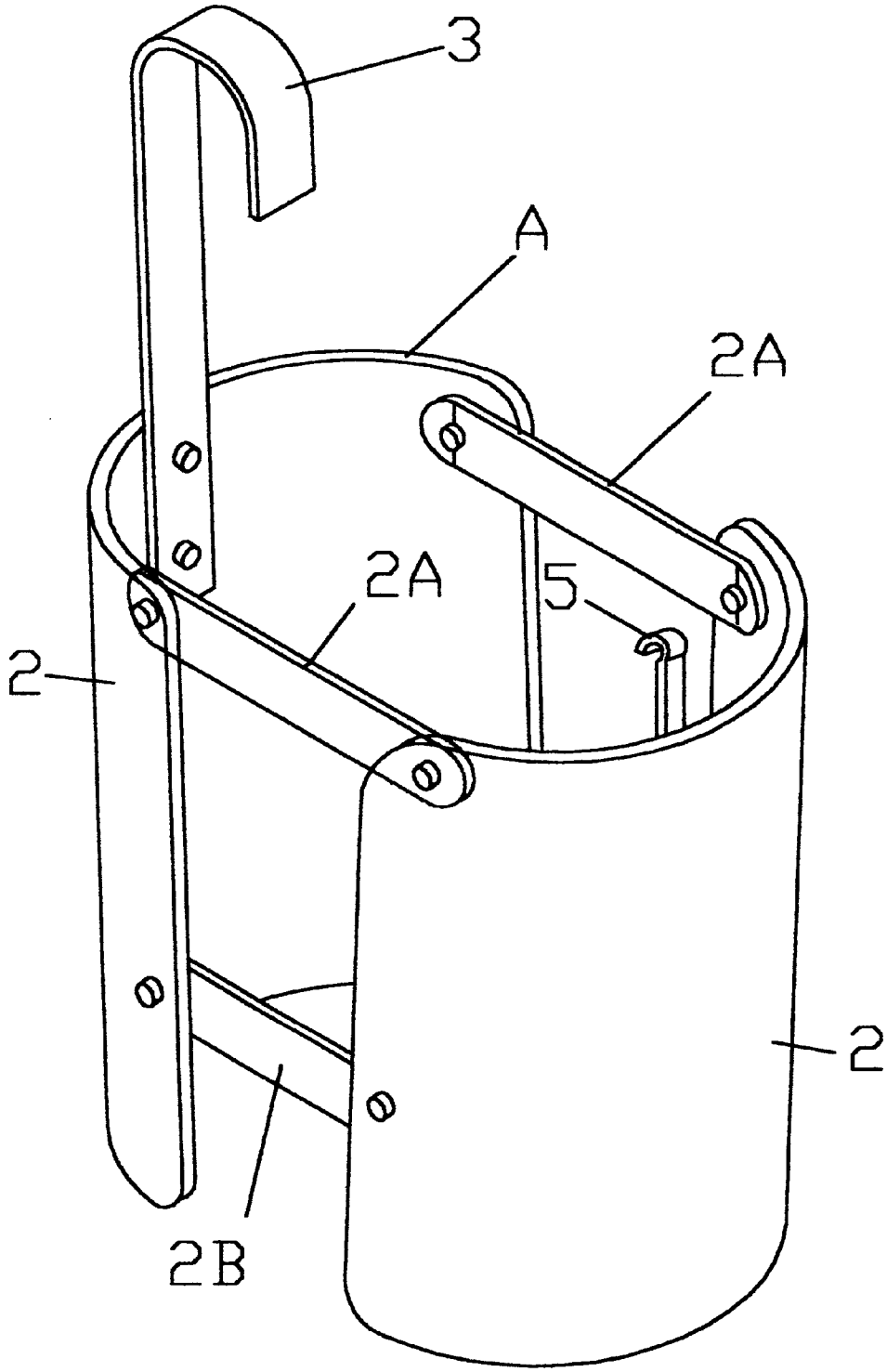
FIG. 3 is a perspective view of a second embodiment of the present invention.
Figure 4:
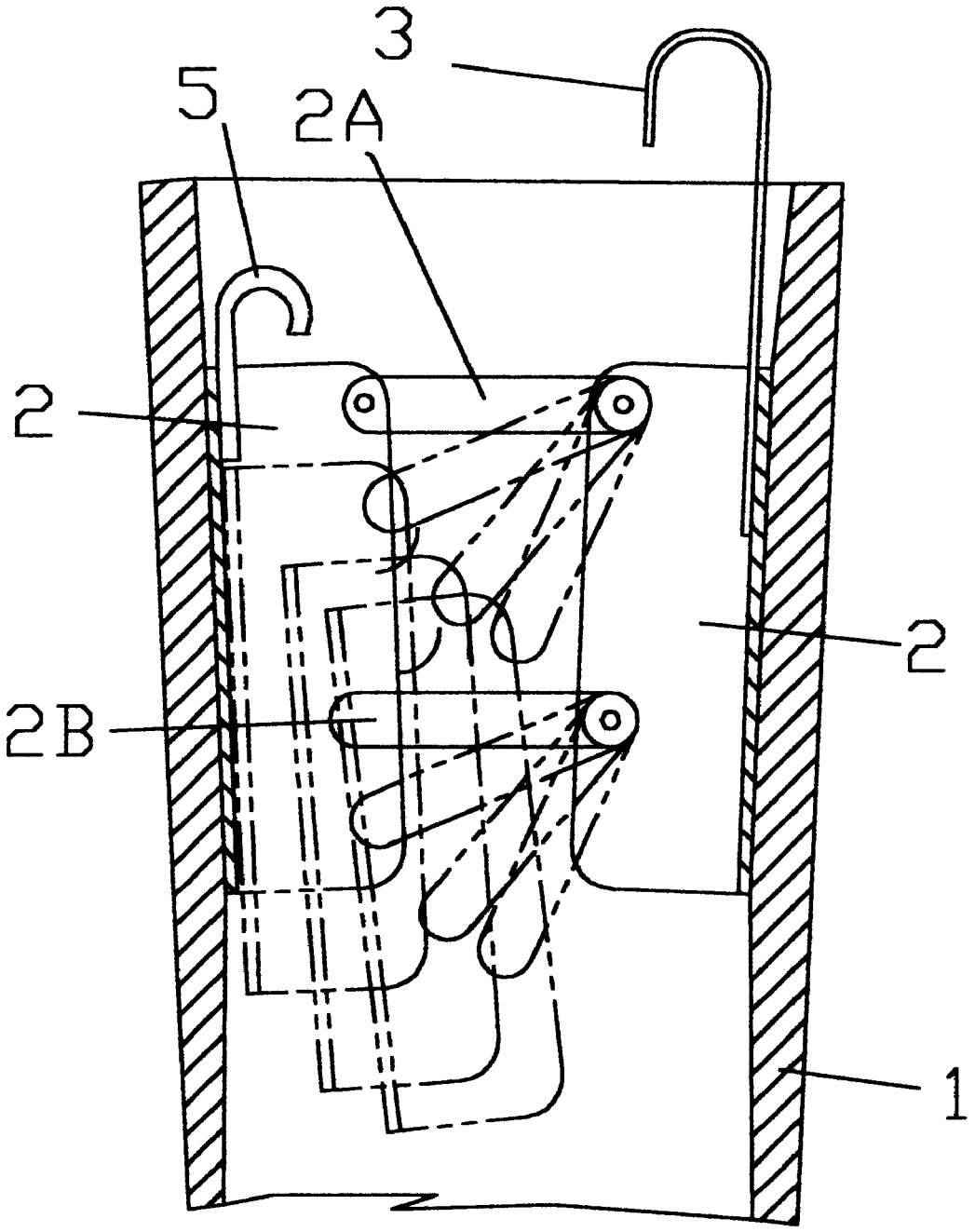
FIG. 4 is a schematic view showing the use of the above.

FIG. 3 is a perspective view showing a boot shape retainer in accordance with a second embodiment of the present invention which includes a pair of arcuate inner pads 2 that are pivotally connected by means of links 2A and 2B so as to be movable relative to each other, as shown in FIG. 4. When one of the inner pads 2 are lifted relative to the other pad, both pads are pivoted about pivot axes of the links 2A and 2B so as to reduce a lateral distance between the inner pads than the inside diameter of the boot 1, allowing the inner pads to be placed inside of the boot 1. After releasing the lifted pad 2, it is caused to fall by its own weight to expand the distance between the pads, thereby pressing both the inner pads against the interior of the boot 1. Thus, the boot is held by the retainer by frictional engagement of the pads with the inner surface of the boot or by engagement of the pads with turn-up ends at the upper brim of the boot and can be therefore suspended or retained by the retainer (A). The arcuate pad may be formed on its exterior with a natural or synthetic leather, an elastic resin coating, or a brush to give an anti-slip finish thereto.

In the illustrated embodiment, the upper link 2A is configured to have a length slightly greater than the lower link 2B to be well suited for the actual boot configuration that the upper boot end has a greater inside diameter than the lower section. However, the links 2A and 2B may be configured to have the same length. Either or both of the links 2A and 2B may be spring-loaded to urge the inner pads 2 against the interior of the boot 1, for example, by placing a torsion coil spring around the corresponding pivot axis of the link.

In the illustrated embodiment of FIGS. 3 and 4, one of the upper and lower links 2A and 2B may be eliminated. For example, when the upper links 2A are removed, the lower links 2B are responsible for pivotally supporting the inner pads 2 so that the inner pads can pivot at its lower end to be capable of inclining outwardly by their own weights, developing sufficient force of retaining the boot. Further, instead of joining the inner pads at their lateral opposite ends by the links, it is equally possible to join the inner pads at their lateral center by the upper and lower links 2A and 2B or only by the lower link 2B.

In FIG. 3, the hook 3 is secured to one of the pads at its upper end, while a release lever 5 is secured to the upper end of the other pad 2. When the release lever 5 is used to lift the corresponding pad 2, the other inner pad 2 is disengaged from the boot and is lowered by its own weight, which makes it easy to remove the retainer (A) out of the boot 1.

Figure 5:
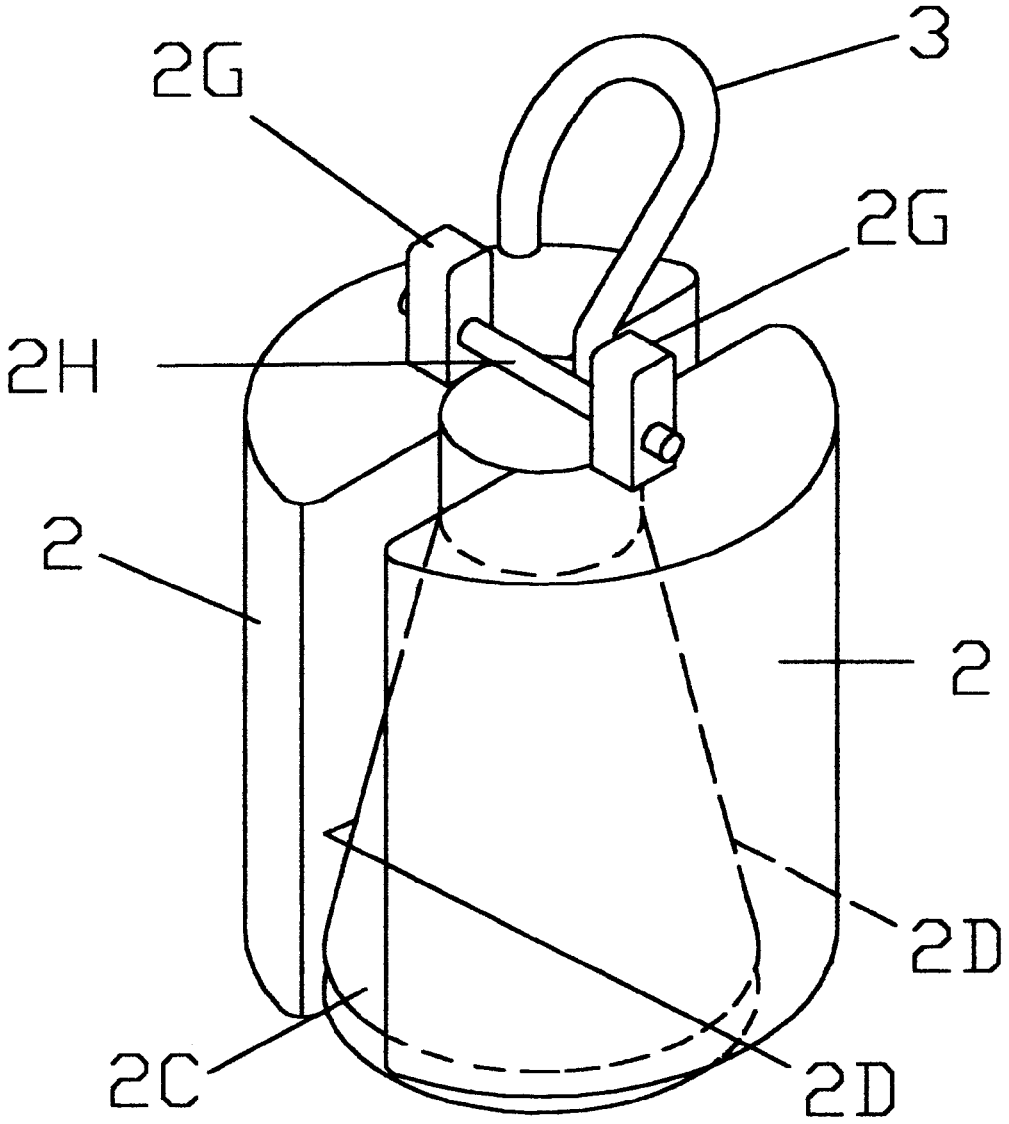
FIG. 5 is a perspective view of a third embodiment of the present invention.
Figure 6:
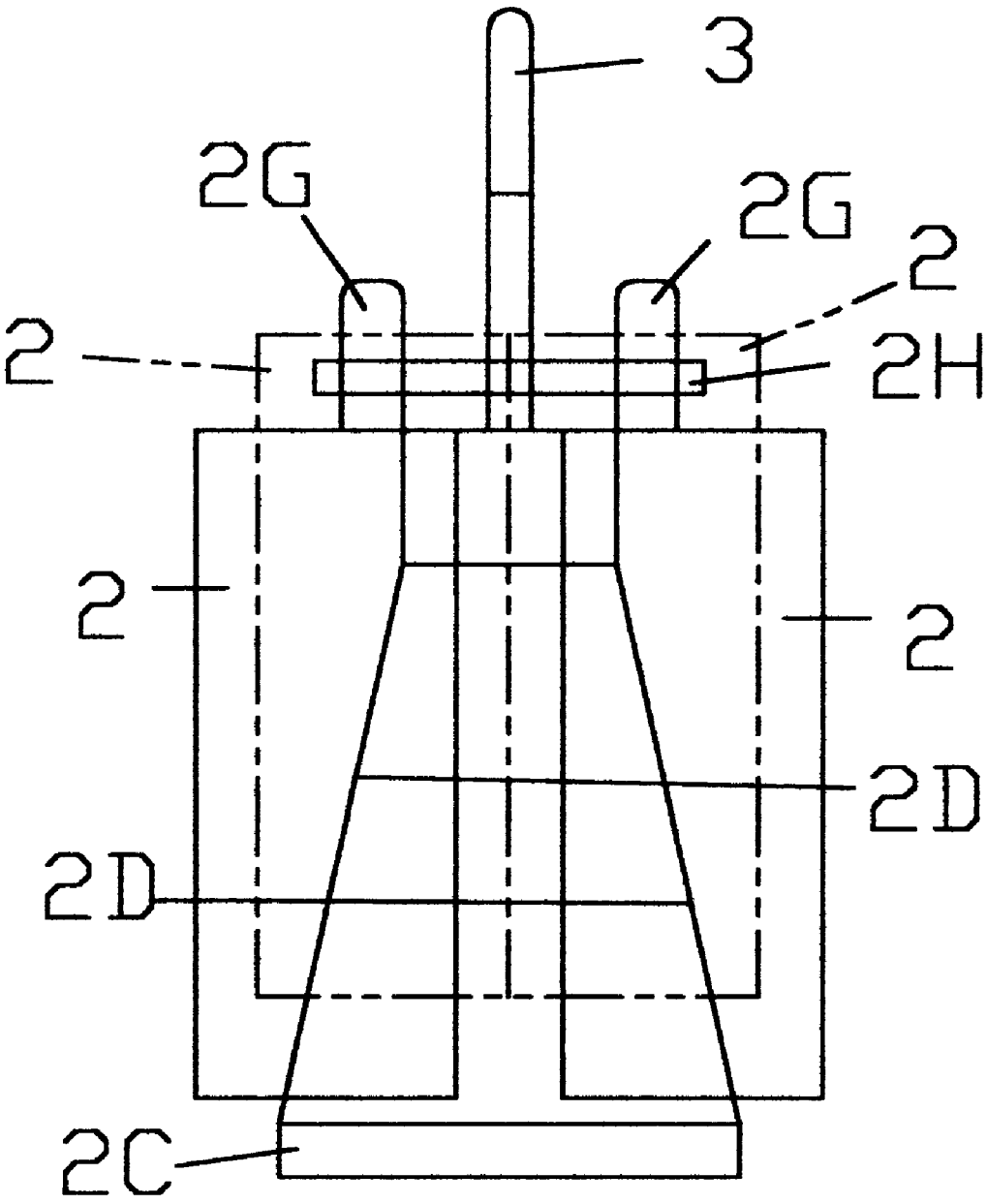
FIG. 6 is schematic view showing the use of the above.

FIG. 5 shows a boot shape retainer (A) in accordance with a third embodiment of the present invention which utilizes a conical core 2C which is held between two or more inner pads 2 and is vertically slidable relative to the pads. In conformity with the conical core, each of the inner pad is formed in its surface with a downwardly flared groove 2D receiving a corresponding portion of the core. The inner pads 2 are interconnected at their upper ends so as to move laterally towards and from each other. The core 2C is provided at its upper end with a hook 3. The inner pads 2 are interconnected by means of an axle 2H which is slidably held by knobs 2G provided at the upper ends of the inner pads 2, respectively. When the retainer (A) is picked up by gripping the knobs, the inner pads 2 are caused to move upward relative the core 2C and accordingly move close to each other, as shown in FIG. 6, so as to be ready for being placed inside the boot 1. After the retainer (A) is released within the boot 1, the inner pads 2 are lowered relative to the core 2C by their own weights, thereby allowed to expand laterally for pressed engagement with the interior of the boot 1.

Figure 7:
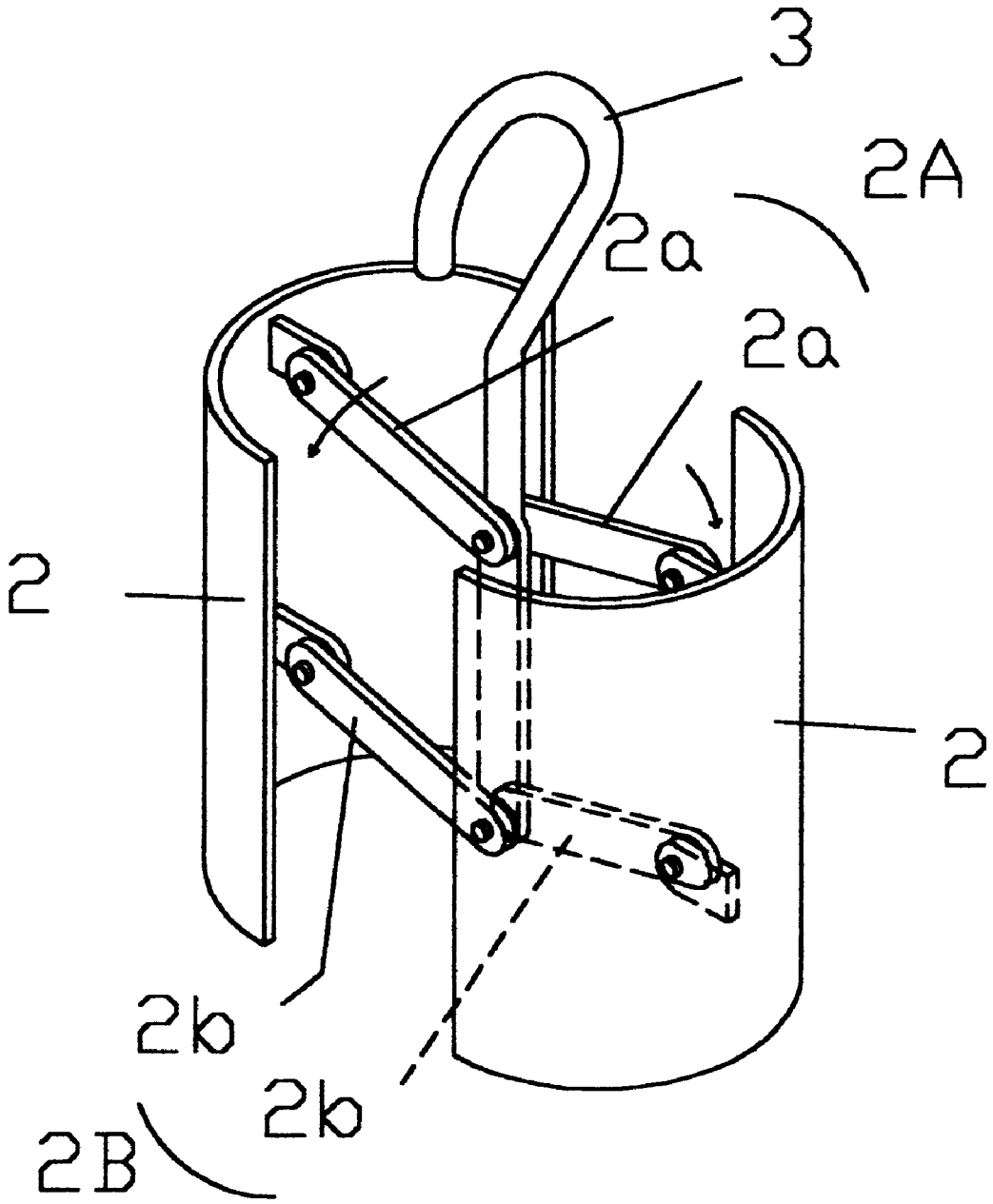
FIG. 7 is a perspective view of a fourth embodiment of the present invention.
Figure 8:
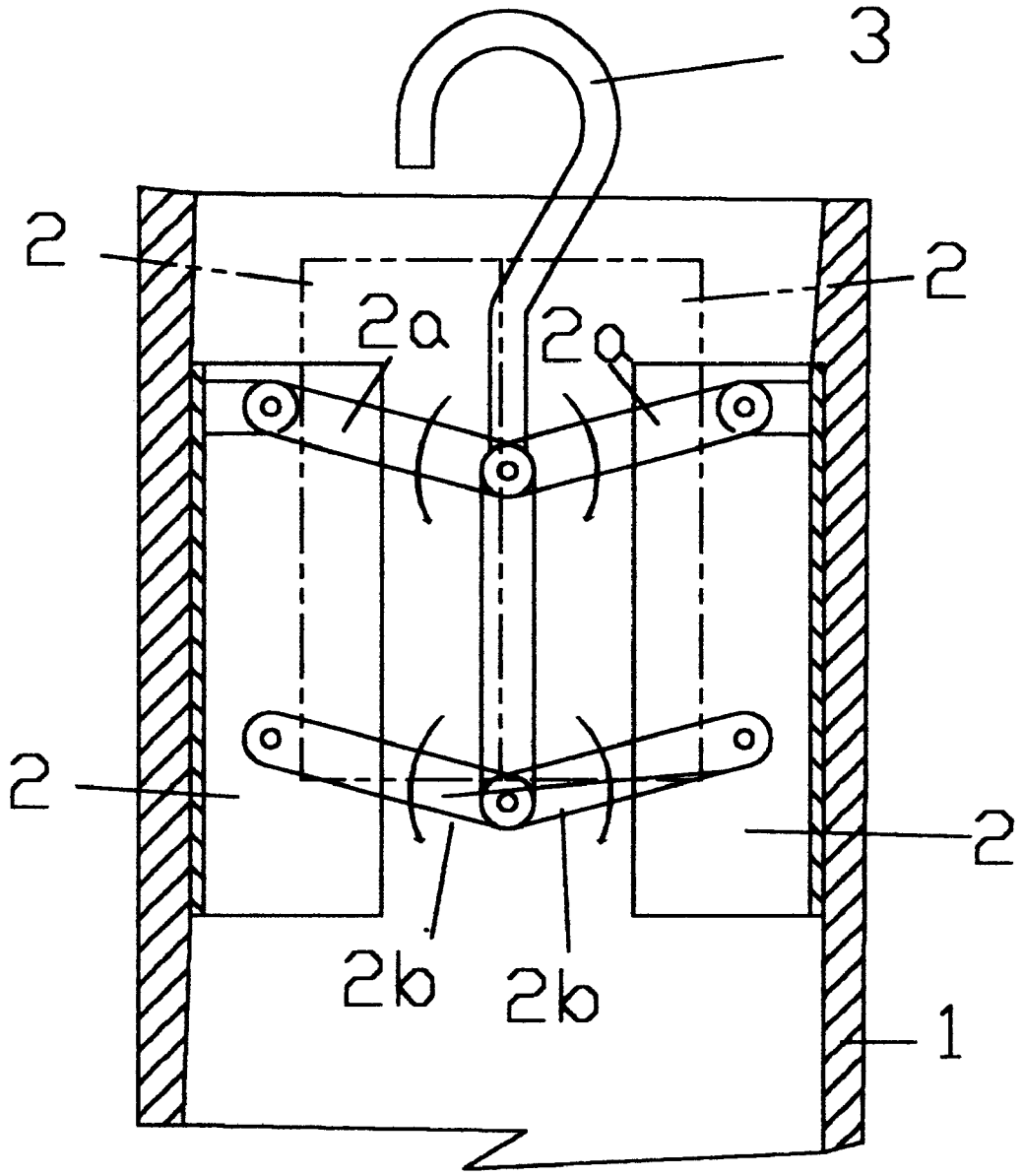
FIG. 8 is schematic view showing the use of the above.

Referring to FIG. 7, there is shown a boot shape retainer (A) in accordance with a fourth embodiment of the present invention which is similar to the second embodiment except that the link 2A and 2B is composed of two swiveled sub-links 2*a* and 2*a* (2*b* and 2*b*) which are pivotally interconnected. Although the inner pads 2 are connected at their lateral center to the links 2A and 2B in the illustrated embodiment, they may be connected to the links 2A and 2B at their lateral opposite ends, in a similar manner as shown in FIG. 3. In this embodiment, the retainer (A) is contracted as indicated by phantom lines in FIG. 8, simply by lifting the inner pads 2 and is subsequently placed into the boot 1. After being released, the inner pads are caused to return by their own weights to a position, as indicated by solid lines, for pressed contact with the interior of the boot 1. Thus, the boot 1 is held by the retainer (A).

Figure 9:
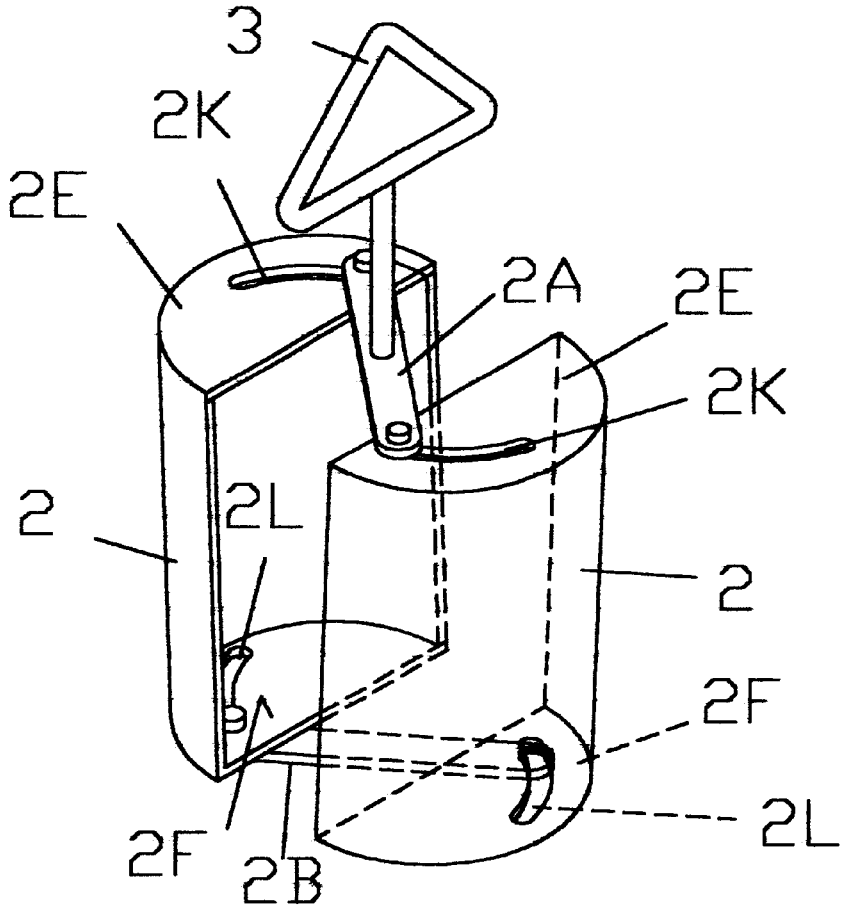
FIG. 9 is a perspective view of a fifth embodiment of the present invention.

FIGS. 9 to 11 show a boot shape retainer in accordance with a fifth embodiment of the present invention which utilizes a pair of semi-cylindrical inner pads 2 interconnected by means of upper and lower links 2A and 2B. Each of the semi-cylindrical inner pads has arcuate slots 2K and 2L respectively in a top face 2E and a bottom face 2F. The upper link 2A has its opposite ends slidably engaged into the slots 2K in the top faces of the inner pads 2, while the lower link 2B has its opposite ends slidably engaged into the slots 2L in the bottom faces of the pads 2 such that the inner pads 2 are movable towards and away from each other. The links 2A and 2B extend to cross with each other, as shown in FIG. 10. Each of the slots 2K and 2L extends along an arcuate path so that the retainer (A) contracts and expands smoothly as the links are manipulated to rotate about a vertical axis. In operation, a hook 3 projecting from the upper link 2A is utilized to rotate the link 2A in a direction of contracting the retainer (A), i.e., moving the inner pads close to each other, as indicated by phantom lines in FIG. 11, after which the inner pads 2 are placed into the boot 1. Then, the hook 3 is again utilized to rotate the link 2A and accordingly the lower link 2B in the reverse direction, thereby moving the inner pads outwardly, as indicated by solid lines in the figure, for pressing the inner pads against the interior of the boot 1 and therefore holding the boot 1.

Figure 12:
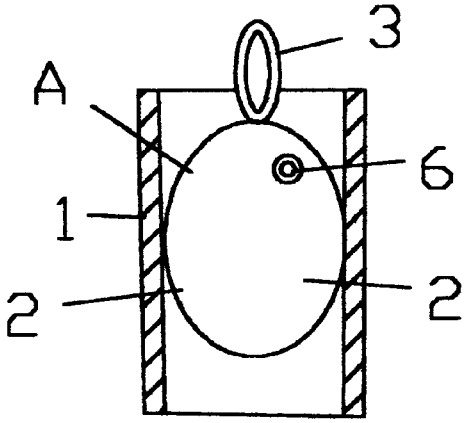
FIG. 12 is a perspective view of a sixth embodiment of the present invention.

FIG. 12 shows a boot shape retainer (A) in accordance with a sixth embodiment of the present invention which utilizes an inflatable bag defining on its exterior a plurality of inner pads 2 for pressed contact with the interior of the boot 1. The bag is made of an elastic material and is supplied with a compressed gas such as the air through a valve 6 and is formed at its upper end with a hook 3.

In any of the embodiments, the retainer may be provided with a vertically extensible stretcher rod 4 of which length is adjusted to make the lower end of the rod in abutment against the inner bottom of the boot 1. When the retainer A is inflated by a fluid, it may be shaped into a doughnut with a center opening through which the stretcher rod 4 extends. Further, the inner pads 2 utilized in any of the embodiment may be designed to give a cylindrical contour having a diameter which is greater towards its upper end such that the inner pads 2 can fit close to the upper wide boot 1 for supporting it at an increased contact area.

Figure 13:
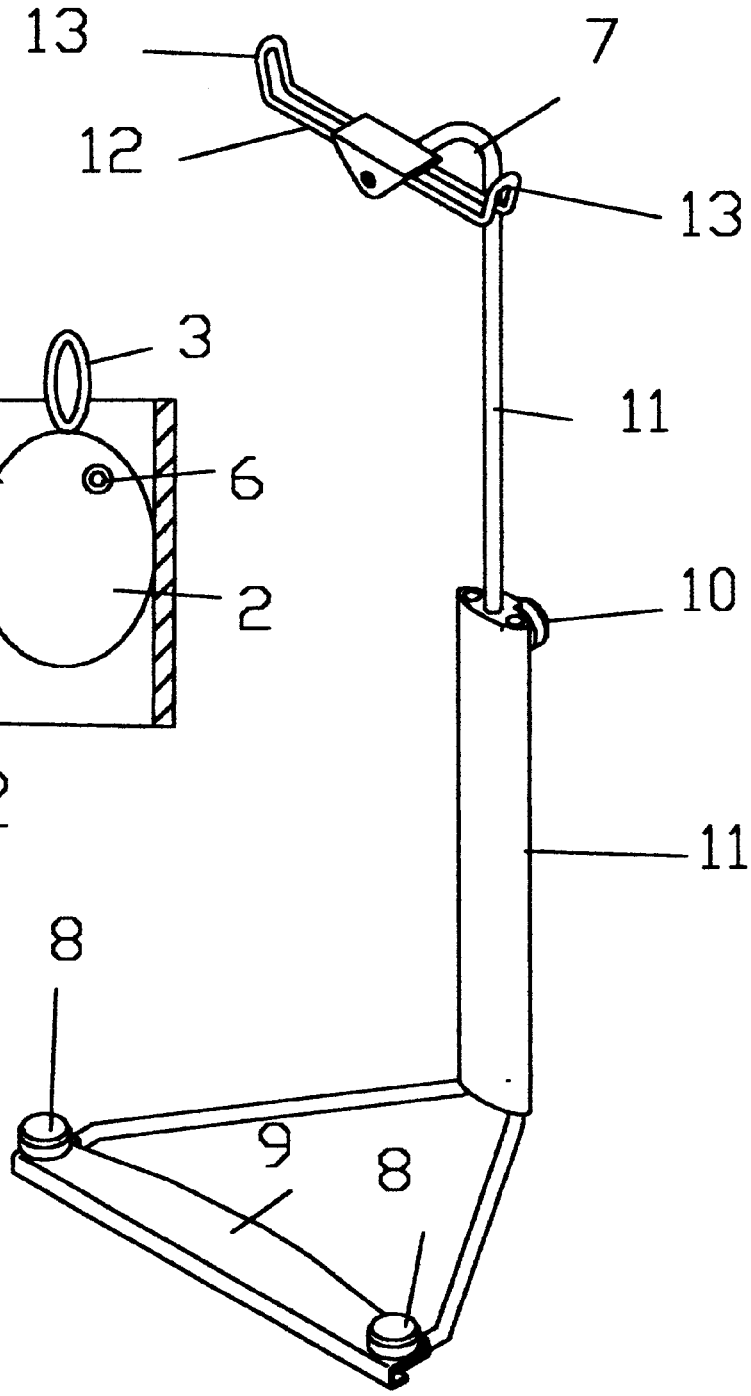
FIG. 13 is a perspective view showing a stand in accordance with the present invention.
Figure 14:
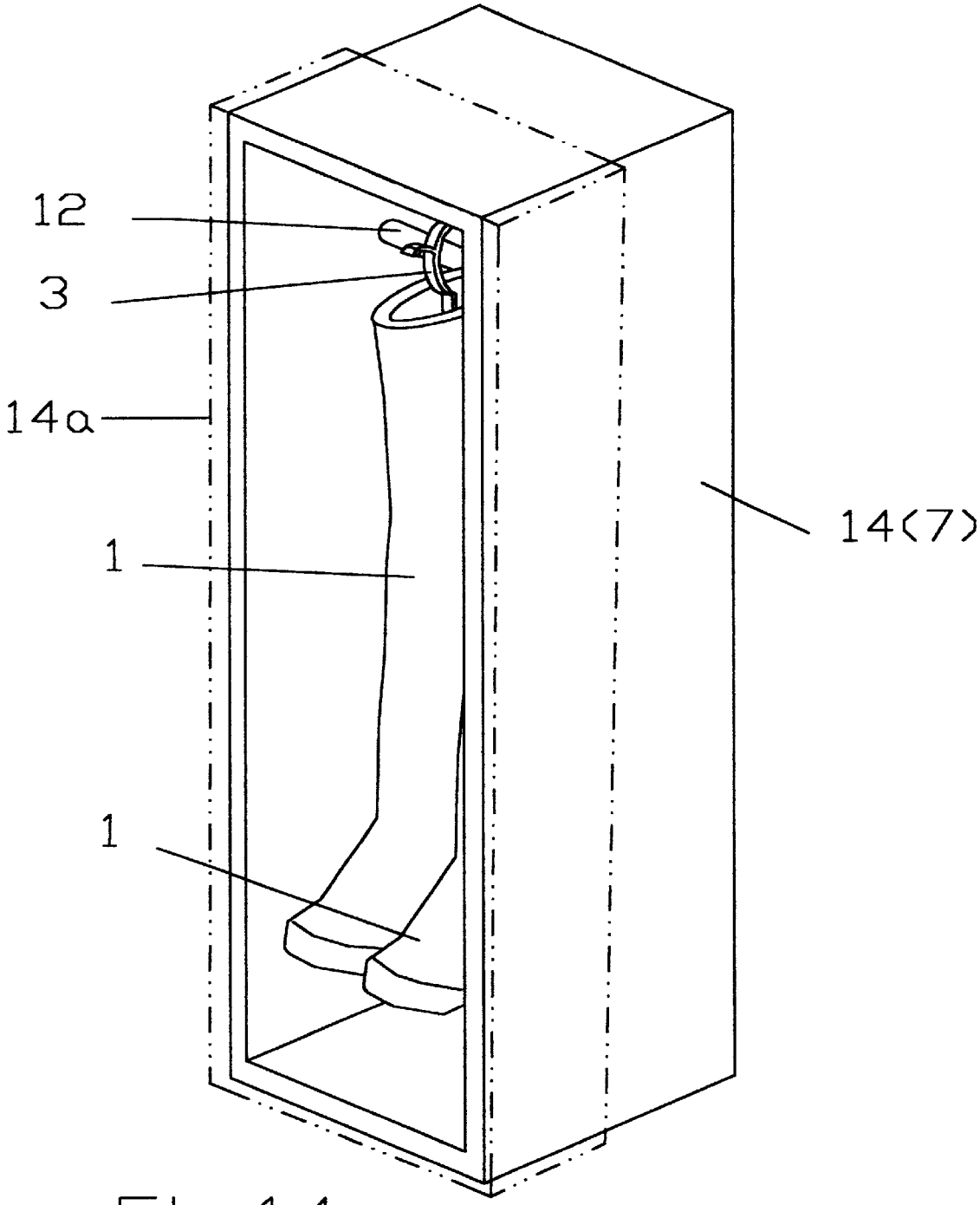
FIG. 14 a perspective view showing an example in which the stand is configured into a container box.

FIGS. 13 and 14 show the stand 7 for suspending the retainer A. The stand 7 of FIG. 13 is configured to make a horizontal adjustment of a foot 9 by means of an adjustor 8 and to make a height adjustment of a pole 11 by means of an adjustor 10. The pole 11 is provided at its upper end with a hanger 12 for hanging engagement with the hook 3 of the retainer A. Stoppers 13 are formed on the opposite ends of the hanger 12. FIG. 14 shows a container box 14 which is made of a paper, plastic, wooden material, or a thin metal to incorporate the hanger 12. The container box 14 itself functions as the stand 7 and can be wrapped into a makeup box. A lid 14*a* may be optionally provided.

Figure 15:
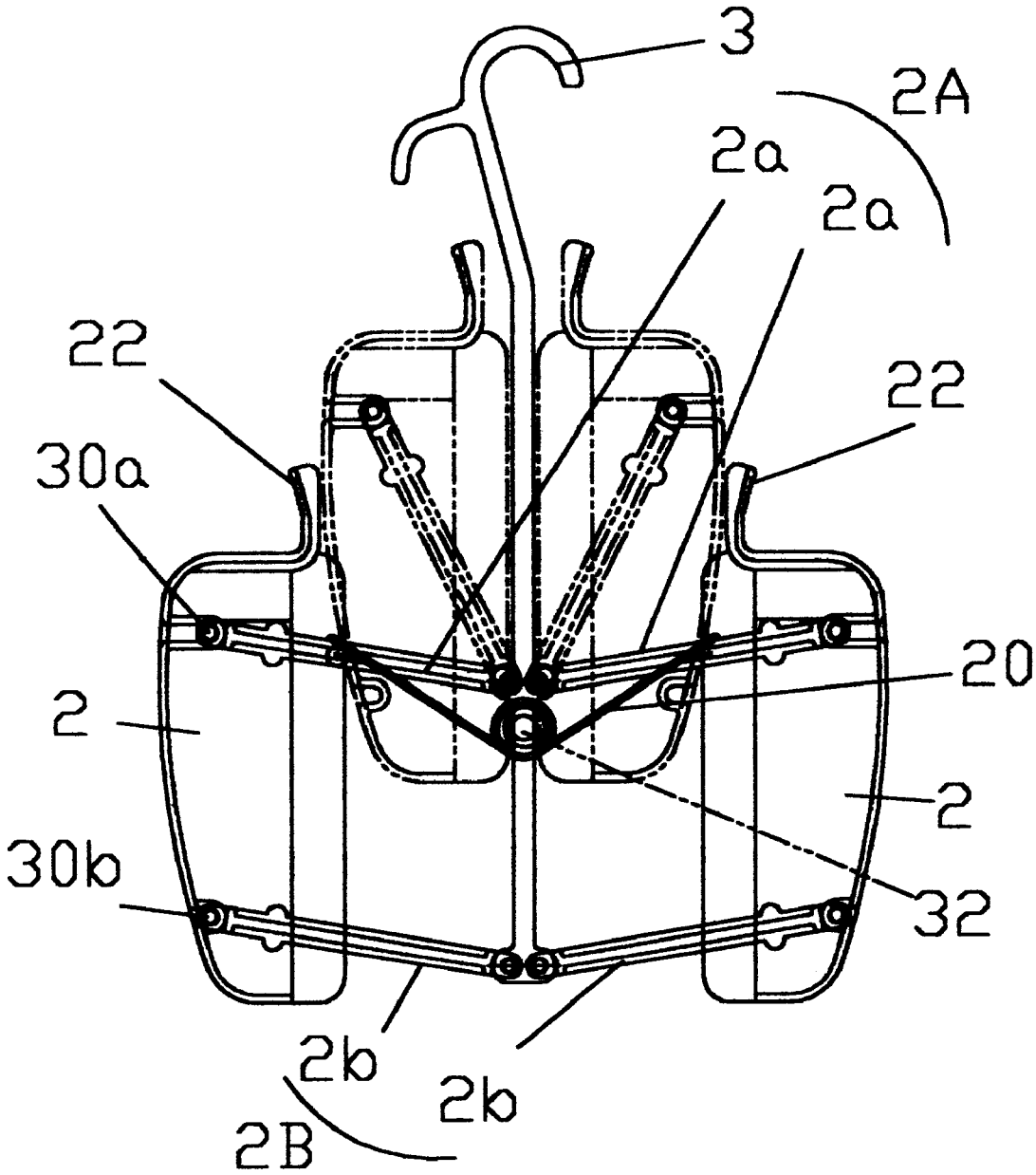
FIG. 15 is a schematic view showing an embodiment in which a spring is added to the links.
Figure 16A:
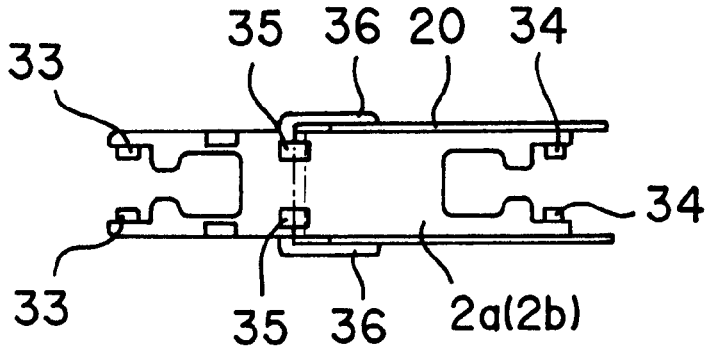
FIGS. 16(*a*), 16(*b*), and 16(*c*) are a plan view of the link, a plane view of the spring, and a front view of the hook of the above.
Figure 16B:
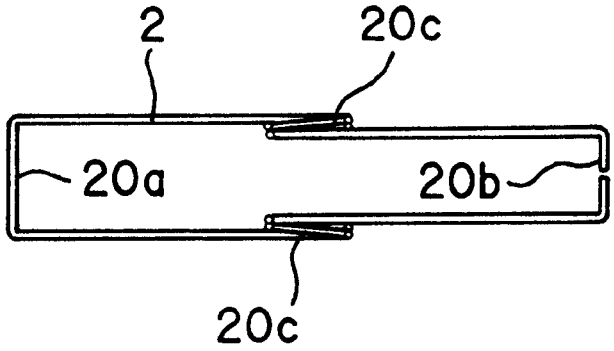
Figure 16C:
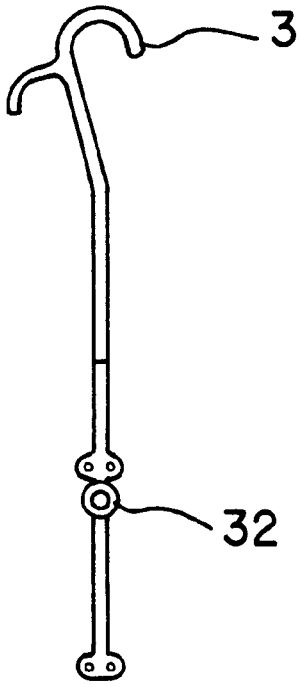

FIG. 15 shows a seventh embodiment of the present invention which is identical to the embodiment of FIG. 7 except for an addition of a spring 20 acting on the links 2A and 2B to constantly bias the inner pads 2 against the interior of the boot 1. Although the spring 20 is provided to act on the upper links, it may act on the lower links or two springs may be provided to act on the upper and lower links, respectively. The inner pads 2 are designed to have a smoothly curved and upwardly flared outer surface in conformity with the upper inside configuration of the boot 1. The outer surface of the pad may have a non-slip finish as necessary.

The inner pad 2 is formed on its rear with upper and lower bearing holes 30*a* and 30*b* for connection with the hook 3 through the links 2*a* and 2*b*. Numeral 32 designates a pin 32 for supporting the spring 20. Said pin 32 can be neglected. Numerals 33 and 34 designate axles of the links 2*a* and 2*b*, respectively. Numeral 35 designates a rest on which the spring 2 acts. Numeral 36 designates a stopper for the spring 2. The inner pads 2 are supported to the hook 3 through the links 2*a* and 2*b* with the axles 33 and 34 being pivotally engaged into the corresponding bearing holes 30*a* and 30*b*. The spring 20 has its center coiled section 20*c* fitted around the pin 32 to have its opposite actuator ends 20*a* and 20*b* pivotally engaged with the rests 35. Also, the actuator end 20*a* is interposed between stopper fins 36 in a slidable relation thereto. The spring may be balanced spring, torsion spring, or coil spring.

In a normal condition, the inner pads 2 are expanded outwardly. When the knobs 22 at the upper ends of the inner pads are picked up, the inner pads 2 are caused to contract, as indicated by phantom lines in FIG. 15, so that they can be placed into the boot 1. Upon releasing the knobs 22, the inner pads 2 within the boot are caused to expand due to the weight of the pads and the links as well as the spring bias, thereby being forced into a pressed contact with the interior of the boot 1 and therefore holding the boot. In this condition, the hook 3 can be utilized for engagement with the hanger 12 of the stand 7 or a hanger pipe in the shoe cupboard. With the provision of the spring, the inner pads 2 can be pressed against the boot at a sufficient retaining force, even when the inner pads 2 and the links 2A and 2B are made of light weight materials such as aluminum or plastics to be alone responsible for producing less retaining force, or when the boot is rather heavy.

As shown in FIG. 2, the stand 7 is utilized to suspend the boot shape retainer (A) holding the boot 1 with the hook 3 engaged with the hanger 12. The stand 7 can be put in the shoe cupboard or be placed in a corner of a room as the boot stand. In a shoe shop or a department's shoe counter, boots can be displayed as being held by the boot stand 7. When stocking the boots during a summer season, the boots can be packed into a deep container as being kept upstand with the retainer (A) held therein.

Figure 18A:
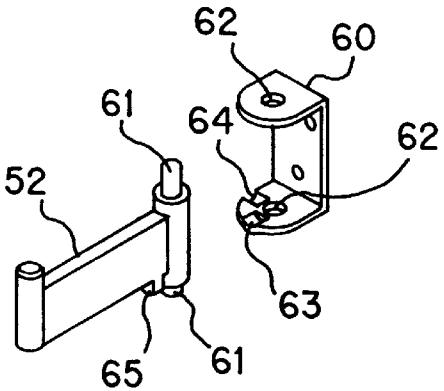
FIGS. 18(*a*) and 18(*b*) are perspective view of a hanger for suspension of the retainer, respectively shown in an exploded condition and in an assembled condition.
Figure 18B:
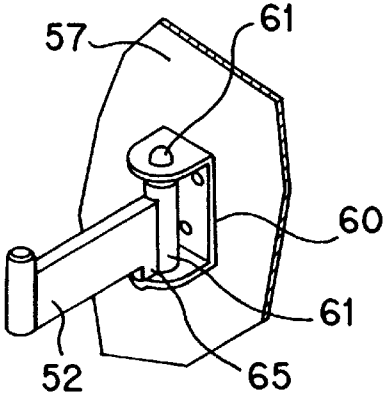
Figure 17:
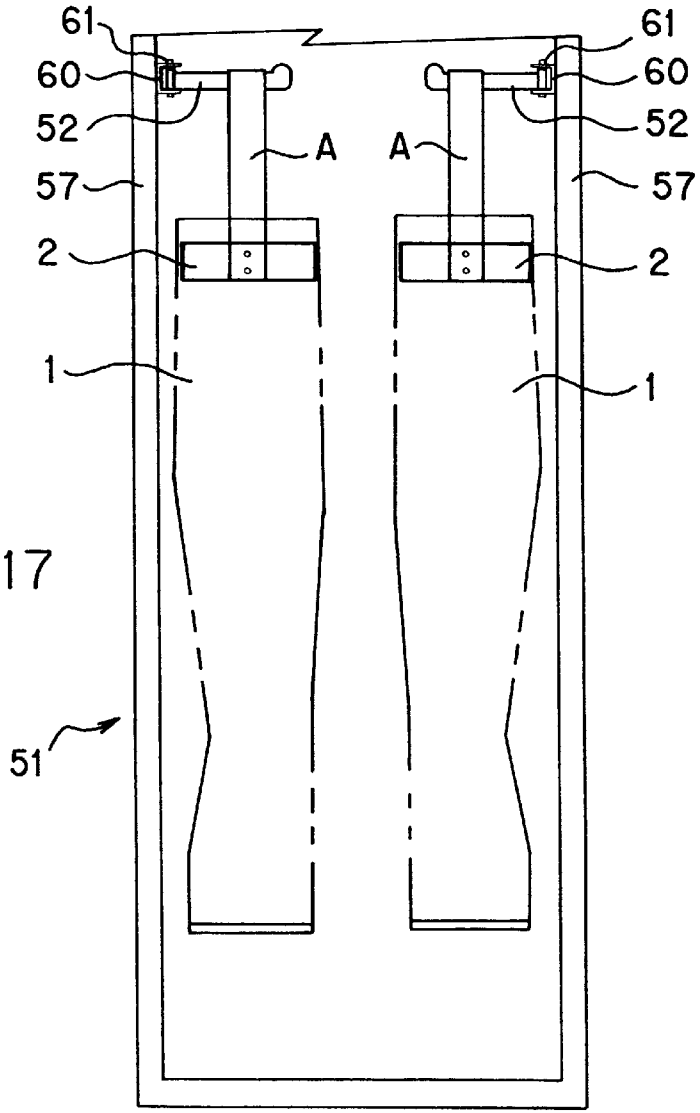
FIG. 17 is a schematic view showing a mounting location of the retainer to the furniture.

FIG. 17 shows an example when the boot retainer (A) is housed in a locker 51 having clothes hangers in its upper part as a typical furniture. The locker 51 is provided on its inner side plates 57 with a foldable hangers 52. As shown in FIG. 18(*a*), a bracket 60 screwed to the side plate 57 has bearing upper and lower holes 62 which receive upper and lower pins 61 of the hanger 52. In this instance, the bracket 60 is formed with recesses 63 and 64 around the lower bearing hole 62 for engagement with a projection 65 formed adjacent the lower pin 61. FIG. 18(*b*) shows one condition in which the hanger 52 projects from the side plate 57 with the projection 65 engaged in the recess 63. From this position, the hanger 52 can be folded on the side plate (57) by being lifted a little and turned about the pins 61 to engage the projection 65 into the recess 64. The hanger 52 may be fixed rather than being foldable on the side plate. Although the illustrated example shows the two hangers 52, it is equally possible to a single elongated hanger 52 supporting the two boot shape retainer (A). The hanger may be formed from a pipe member.

When the boot shape retainer is housed in the shoe cupboard 51 having a partition 56, the hangers 52 may be mounted on opposite lateral sides or on front and rear of the lower surface of the partition 56. The hangers may be fixed or movably (foldably) supported. Also, each hanger 52 may be designed to suspend the two boot shape retainers (A). Further, the hanger 52 may be provided on a side plate 57 of a space below the partition 56.

The hanger 52 may be extensible or slidable so as to be drawn out from the furniture 51 for engagement with the boot shape retainer (A). Thereafter, the hanger 52 is put back into the furniture 51 together with the boot shape retainer holding the boot. This facilitates the storage of the boots in to the furniture having a narrowed space below the partition 56.

Figure 19:
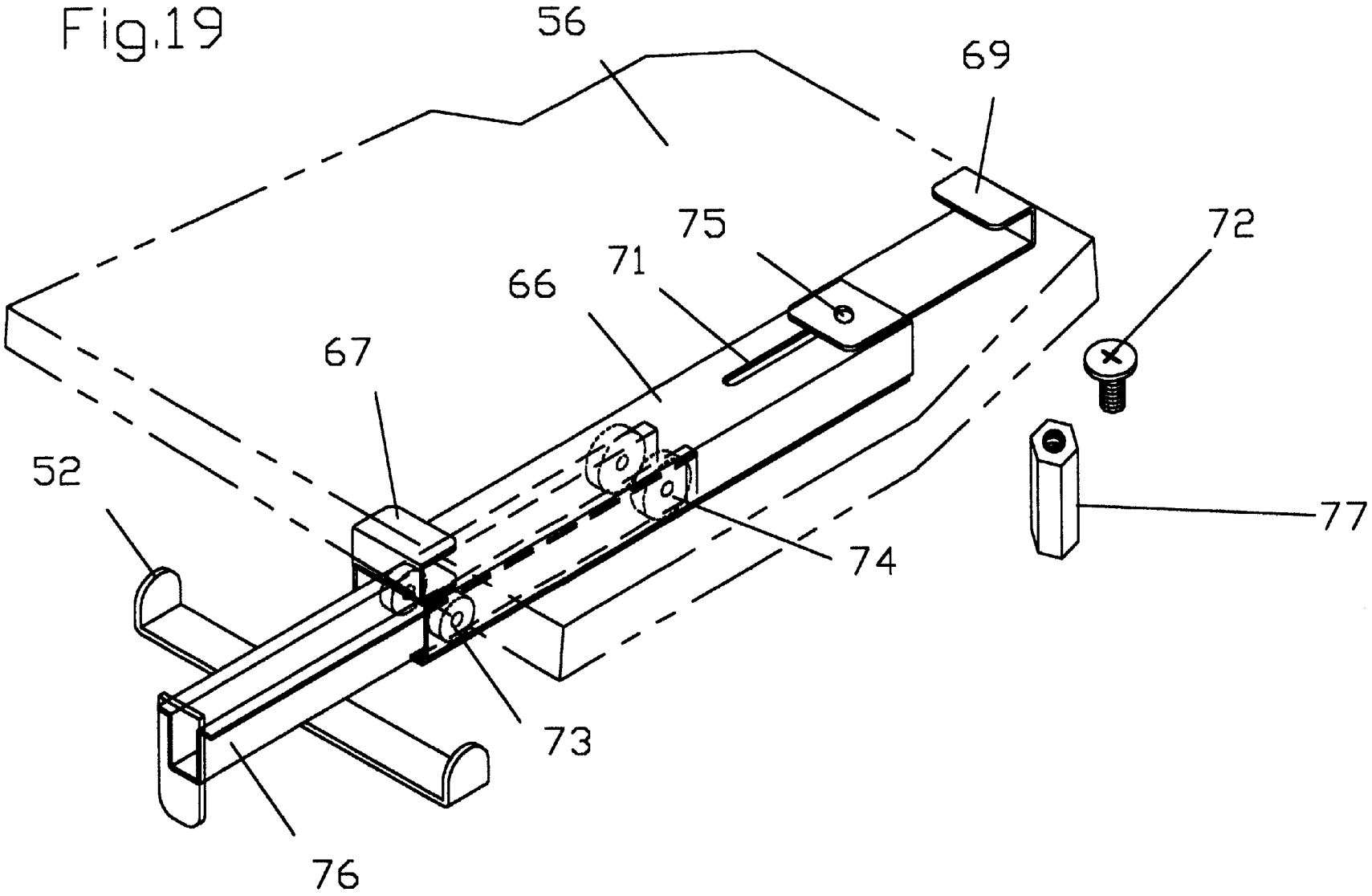
FIG. 19 is a schematic perspective view of another hanger for mounting the retainer to the furniture.

FIG. 19 shows an example in which the partition 56 is provided on its bottom with a longitudinal rail 66 along which the hanger 52 is slidable. A slider 76 is provided to slidably support the hanger 52 to the rail 66. The slider 76 may be short in length but is preferred to have sufficient length and to carry the hanger 52 at its front end, as illustrated, so that the hanger 52 can be drawn out of the furniture 51. Thus, the boot shape retainers (A) can be held on opposite lateral ends of the hanger 52 to suspend the boots 1, after which the boots 1 can be easily put into the space simply be being pushed in.

A catch 67 at the front end of the rail 66 is engaged with the front end of the partition 56 and is optionally screwed thereto. A rear catch 69, is also provided for engagement with the partition 56, and it can be adjusted to be in match with the length of the partition by engagement of a cap screw 72 into a slot 71. The rear catch 69 may be optionally screwed to the partition. The cap screw 72 is temporarily held to the rear catch 69 by being threadedly mated with a countersink 75 in the catch. After adjusting the position of the catch 69, the cap screw 72 is tightened to a nut 77 for fixing the catch to the rail. The catch 69 may be provided on its rear face with an adhesive tape for bonding the partition with a rear wall of the furniture 51. Thus, the partition 56 could be prevented from wobbling or coming off when the hanger 52 is drawn out.

The rail 66 and the slider 76 may be provided with rollers 73 and 74 for smoothly sliding the hanger 52. The rear catch 69 may be eliminated. This example is suitable for a case in which the partition 56 is a flash-board to which the hanger 52 is difficult to be directly screwed.

Figure 20:
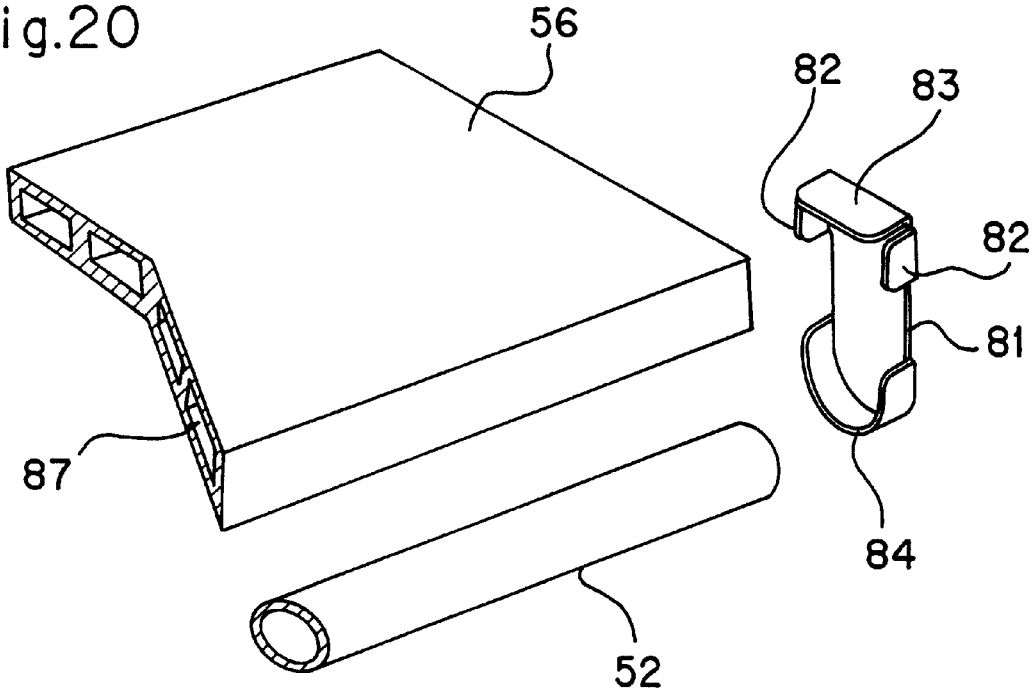
FIG. 20 is an exploded perspective view of a brace for fixing a pipe hanger to a partition.

FIG. 20 shows an example in which the partition 56 is a flash-panel having ends to which flash openings 87 are exposed. An associated brace comprises a vertical segment 81 formed at its upper end with a horizontally extending tab 83 for engagement with the upper surface of the partition 56. Projecting form the segment from portions slightly below the tab 83 are insertion tabs 82 of which vertical dimension is equal to or slightly greater than the corresponding height of the opening 87. One or more than two insertion tabs 82 may be provided in accordance with the shape and the number of the flash openings 87. Formed at the lower end of the vertical segment 81 is a U-shaped holder 84 for holding the hanger in the form of a pipe. The brace is formed from a metal or plastic material.

Figure 21:
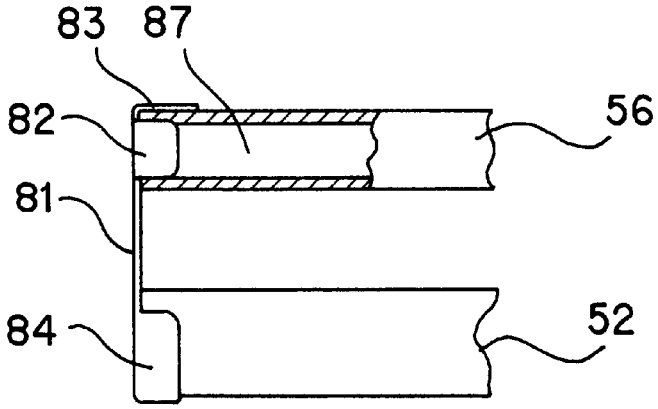
FIG. 21 is schematic view partly in section showing the connection of the brace to the partition.

A couple of the braces are used at the opposite ends of the hanger 52 for supporting it to the partition 56 of the shoe cupboard or the like furniture by engaging the tabs 82 at the upper surface of the partition 56, as shown in FIG. 21, and at the same time by pushing the insertion tabs 83 into the flash opening 87. Thereafter, the hanger 52 in the form of a pipe is supported to the brace with the opposite ends of the pipe retained by the holder 84. Thus, the hanger 52 can be easily removed when it is not necessary to suspend the boots 1. The outer face of the brace is flat for contact with the side plate of the furniture (not shown).

The vertical segment 81 of the brace can fill a gap left between the partition and the opposed side plate to thereby prevent the wobbling of the partition 56. It is noted in this connection that the hook 3 can be utilized for engagement with a rotary hanger 52 provided in a rotary closet as another example of the furniture in addition to the shoe cupboard and the locker, in order to suspend the boots in such rotary closet.

Instead of the insertion tabs 82, the brace may be provided with a pointed or nailed anchor tab which is capable of being driven into the wood-made partition 56 or the like partition for fixing the brace to the partition.

LIST OF REFERENCE MARKINGS

1 boot
2 inner pad
2A link
2B link
2C core
2D groove
2E top face
2F bottom face
2*a* link
2*b* link
3 hook
4 stretcher rod
5 stand
A retainer
52 furniture
52 hanger

What is claimed is:

1. A boot shape retainer comprising:

at least one pair of spaced inner pads movable to conform to a boot at two or more points around an interior circumference of an upper end of the boot, wherein said inner pads are pivotally supported at opposite ends of a link; and a hook is connected to the inner pads and adapted to be engaged with a suspending device; and said link comprises a pair of sub-links, with one end of each sub-link being pivotally connected directly to an inner pad and the opposite end being pivotally connected together, by a common pin passing through the hook and one end of each sub link, to the opposite end of the other sub-link; and wherein, when either of said inner pads is lifted relative to the other, the distance therebetween is reduced to enable insertion into the upper end of the boot, and after insertion, the weight of a pad causes the same to move outwardly to contact the interior circumference of the upper end of the boot to frictionally engage and support the boot.

2. A combination of a boot shape retainer as recited in claim 1 and a suspending device, said suspending device including a slidingly height adjustable stand for engaging with said hook for suspending the boot shape retainer.

3. A combination of a boot shape retainer as recited in claim 1 and a suspending device, wherein said suspending device includes a hanger adapted to be secured on furniture such as a locker or a shoe cupboard and to be engaged with said hook for suspending the boot shape retainer.

* * * * *

UNITED STATES PATENT AND TRADEMARK OFFICE

CERTIFICATE OF CORRECTION

PATENT NO. : 6,622,331 B2
DATED : September 23, 2003
INVENTOR(S) : Shojiro Yanagi It is certified that error appears in the above-identified patent and that said Letters Patent is hereby corrected as shown below:

Title page,
Item [73], Assignee, should read as follows:
-- [73] Assignee: Kenichi Ooka, Osaka (JP) --.

Signed and Sealed this

Tenth Day of February, 2004

JON W. DUDAS
*Acting Director of the United States Patent and Trademark Office*